United States Patent [19]

Woodward et al.

[11] 4,342,999

[45] Aug. 3, 1982

[54] LOOP ANTENNA ARRANGEMENTS FOR INCLUSION IN A TELEVISION RECEIVER

[75] Inventors: Oakley M. Woodward; John G. N. Henderson, both of Princeton, N.J.

[73] Assignee: RCA Corporation, New York, N.Y.

[21] Appl. No.: 210,251

[22] Filed: Nov. 25, 1980

[51] Int. Cl.[3] ..... H01Q 1/24; H01Q 1/26

[52] U.S. Cl. ..... 343/702; 343/742; 343/748; 455/274; 455/291

[58] Field of Search ..... 343/701, 702, 741, 742, 343/743, 748; 455/274, 291

[56] References Cited

U.S. PATENT DOCUMENTS

| | | | |
|---|---|---|---|
| 2,202,368 | 5/1940 | Berndt | 250/33 |
| 2,229,984 | 1/1941 | Moser | 250/11.5 |
| 2,235,163 | 3/1941 | Peterson | 250/33 |
| 2,247,743 | 7/1941 | Beverage | 250/33 |
| 2,322,126 | 6/1943 | Grimditch | 250/40 |
| 2,327,485 | 8/1943 | Alford | 250/33 |
| 2,514,992 | 7/1950 | Edelsohn | 250/33 |
| 2,551,664 | 5/1951 | Galper | 250/33 |
| 2,615,134 | 10/1952 | Carter | 250/33.67 |
| 2,679,001 | 5/1954 | Tomcik | 250/20 |
| 2,881,429 | 4/1959 | Radcliffe | 343/744 |
| 3,906,506 | 9/1975 | Verma et al. | 343/702 |
| 4,251,808 | 2/1981 | Lichtblau | 340/572 |

OTHER PUBLICATIONS

J. Gibson and R. Wilson, "The Mini-State-A Small Television Antenna", *RCA Engineer,* vol. 20, No. 5, Feb.-Mar. 1975, pp. 9-19.

L. Weller and J. Gosch, "Reception is Loud and Cool for Subminiature Antennas", *Electronics,* Jun. 12, 1967, pp. 145-151.

J. Wesling and G. Lapidus, "Transistor Unit May Cue End of Roof TV Antenna", *Electronic News,* Apr. 24, 1967.

*Primary Examiner*—Eli Lieberman

*Attorney, Agent, or Firm*—Eugene M. Whitacre; Paul J. Rasmussen; Clement A. Berard, Jr.

[57] ABSTRACT

A single-turn loop antenna suitable for inclusion within the cabinet of a television receiver has at least one gap forming a pair of feed terminals. Circuitry connects to the feed terminals for tuning the antenna over at least a portion of the television frequency bands and for coupling signals from the feed terminals to a transmission line. The circuitry provides isolation so the tuning of the antenna by the tuning circuitry is unaffected by the impedance of the transmission line or its terminating impedance and variations thereof. The circuitry is affixed to the loop proximate to the feed terminals, and the transmission line is affixed to the periphery of the loop and departs therefrom at a neutral point located, for example, opposite to the gap.

28 Claims, 8 Drawing Figures

LOOP ANTENNA ARRANGEMENTS FOR INCLUSION IN A TELEVISION RECEIVER

This invention relates to loop antenna arrangements and, in particular, to those suitable for inclusion within the cabinet of a television receiver.

Conventional television receivers employ monopole or dipole (rabbit ears) antennas for receiving television signals in the lower (54–88 MHz) or upper (174–216 MHz) very high frequency (VHF) television bands. While those arrangements provide acceptable quality of reception in locations close to the transmitting station, they are considered by some to be unsightly, difficult to adjust, and susceptible to damage through abuse. Thus, there exists a need for an antenna arrangement that can be included within the cabinet of a television receiver and which does not require adjustment by the viewer. A loop antenna can satisfy that need.

Loop antennas are described generally by W. Berndt in U.S. Pat. No. 2,202,368, by H. H. Beverage in U.S. Pat. No. 2,247,743, and by P. S. Carter in U.S. Pat. No. 2,615,134. In such loop antennas, received signals are conducted to a receiver via a transmission line, such as a coaxial cable. If this line is not terminated in its characteristic impedance, antenna tuning becomes difficult. Tuning becomes more difficult as the line becomes longer. If a balun is used, it can tend to make tuning the antenna more difficult and to introduce additional undesirable losses. Therefore, eliminating the balun can be beneficial.

In a television receiver, reception over the full lower and upper VHF frequency bands requires that the antenna be tuned, i.e., that the inductive reactance of a loop type antenna be resonated with a capacitive reactance either in series or parallel connection therewith. Tuning is accomplished by the tuner. Because the input impedance of a tuner in a television receiver varies widely over the television frequency bands, satisfactory tuning is impractical with known small antenna arrangements.

Loop antennas built into television receivers are shown by S. Galper in U.S. Pat. No. 2,551,664, by C. R. Edelsohn in U.S. Pat. No. 2,514,992, and by J. K. Verma et al. in U.S. Pat. No. 3,906,506. Those antennas fail to address the difficulties associated with the transmission line or require viewer intervention for tuning, as discussed above.

Those problems are overcome by the antenna arrangement of the present invention for inclusion within a television receiver. In the present antenna arrangement, an electrically conductive loop has at least one gap which defines respective first and second feed terminals, and has a neutral point thereon. Input circuitry including tuning circuitry for tuning the loop over at least a portion of the frequency bands is located proximate to the gap for receiving input signals from the loop. Signals are coupled from the tuning circuitry to an output terminal so that tuning of the antenna by the tuning circuit is substantially unaffected by an impedance connected at the output terminal. A transmission line disposed along the periphery of the loop between the output terminal and the neutral point departs from the loop proximate to the neutral point and couples output signals from the input circuitry to the circuitry of the receiver. The antenna arrangement is thereby rendered less sensitive to the length of the transmission line and to the value of its terminating impedance.

IN THE FIGURES

Figure 1:
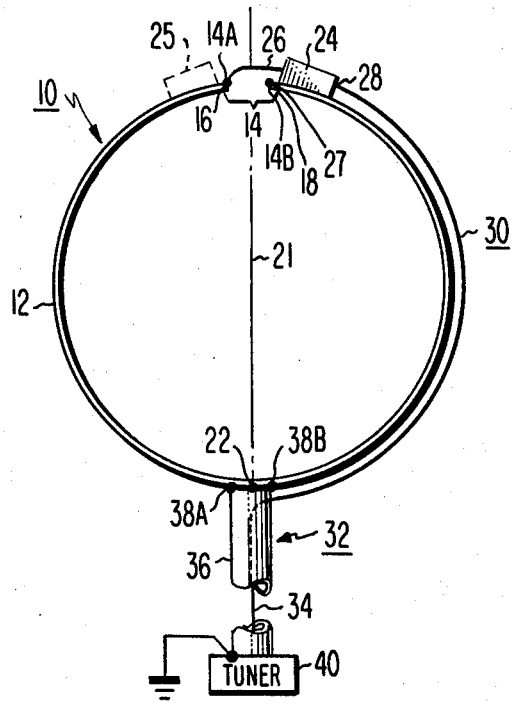
FIGS. 1 and 5 are embodiments of antennas including the present invention.

Antenna 10 of FIG. 1 is a VHF television receiving antenna including a single-turn loop 12 of an electrically conductive material such as a metal band. Gap 14, of small dimension relative to the circumference of the loop, defines feed terminals 14A and 14B at the ends of metal band 12. Although loop 12 is shown by way of example as being circular, that such loops may be square, rectangular, or other shapes not necessarily regular. Loop 12 is generally electrically small, i.e. its diameter or diagonal is desirably less than 1/5 the wavelength of the highest frequency of interest (e.g., VHF channel 13).

Neutral point 22 is a point on loop 12 the potential of which is equal to the average of the potential at feed terminals 14A and 14B when electromagnetic radiation impinges upon loop 12. Stated in another way, with neutral point 22 at ground potential, as is often desirable, the potentials at feed terminals 14A and 14B will be of substantially equal amplitude but of opposite phase.

The potential at the center of gap 14 is the same as the potential at neutral point 22. All points on line 21 are also at that same potential; line 21 being defined between the center of gap 14 and neutral point 22. Where loop 12 is of symmetrical shape and in a single plane, line 21 is the intersection of the plane of loop 12 with a neutral plane (not shown), oriented perpendicularly with respect to the plane of the loop 12.

Input circuitry for tuning the antenna and for coupling signals therefrom to transmission line 30 are located on loop 12 proximate to gap 14 and within container 24. Feed terminals 14A and 14B in the embodiment of FIG. 1 include connection points designated as signal terminals 16 and 18, respectively. Signal terminals 16 and 18 connect to the tuning circuitry via conductors 26 and 27, respectively. Output terminal 28 of the input circuitry connects to a conductor of transmission line 30 which is disposed along the periphery of loop 12 between output terminal 28 and neutral point 22. Thus, fields associated with transmission line 30 tend not to disturb the pattern of antenna 10. At neutral point 22, transmission line 30 departs from loop 12 for carrying signal to tuner 40. Where line 30 takes the form of coaxial cable 32, it includes center conductor 34 connected to terminal 28 and outer concentric conductor 36 connected to loop 12 at various points. Outer conductor 36 electrically connects to loop 12 at points 38A and 38B, for example, and to tuner 40. Conductor 36 connects to a point of reference potential, such as ground potential, conventionally at tuner 40. Since the neutral point is thereby at ground potential, potentials developed along loop 12 by impinging electromagnetic radiation are anti-symmetrical with respect to line 21 so that full signal potential is developed between signal terminals 16 and 18.

Coaxial cable 32 is desirably disposed within the neutral plane (not shown) as it departs from loop 12 so that the radiation pattern of the antenna is not disturbed by the pressure of the conductors. In practice, due to the relative location of antenna 10 and tuner 40, such may not be possible for more than a nominal distance.

The tuning circuitry is desirably located proximate to signal terminals 16 and 18 which are as close as possible to antenna feed terminals 14A and 14B. As a practical matter in the embodiment of FIG. 1, terminals 14A and 16 are substantially the same point, as are terminals 14B and 18. Conductors 26 and 27 are short and therefore tend not to affect tuning. Further, because the tuning circuit is isolated from transmission line 30 by the coupling circuitry, tuning is desirably unaffected by the length or characteristics of line 30 or by the input impedance of tuner 40. Because line 30 is disposed along loop 12 and departs at neutral point 22, it tends not to disturb the reception pattern of antenna 10. The arrangement thus described therefore substantially eliminates the problems discussed above with respect to known antenna arrangements.

It is desirable that the tuning and coupling circuitry be physically small so that it does not materially disturb the electromagnetic fields near the antenna. It is also desirable that the circuitry be enclosed within container 24 of an electrically conductive material. When the circuitry is desirably small then so may be container 24. In the event that electrically conductive container 24 is of such size to undesirably disturb the symmetry of the fields near antenna 10, the disturbance can be lessened by the addition of container 25. Container 25 is preferably of similar size and shape to that of container 24 and is located proximate to feed terminal 14A and symmetrically disposed with container 24 in relation to gap 14.

Loop 12 is desirably constructed of a band 12 of electrically conductive material such as copper oriented with its width perpendicular to the plane of antenna 10. In FIG. 1, the width of the band is perpendicular to the plane of the paper on which the FIGURE is drawn. Increasing the width of the band increases the radiation resistance of the antenna which beneficially increases its efficiency as is described by J. J. Gibson and R. M. Wilson in "The Mini-State—A Small Television Antenna", *RCA Engineer*, Vol. 20, No. 5, February–March 1975, p. 12. Empirical results show that a width of about two inches is satisfactory in the VHF television bands. Further increases in width seem to produce proportionally less significant increases in radiation resistance.

Figure 2:
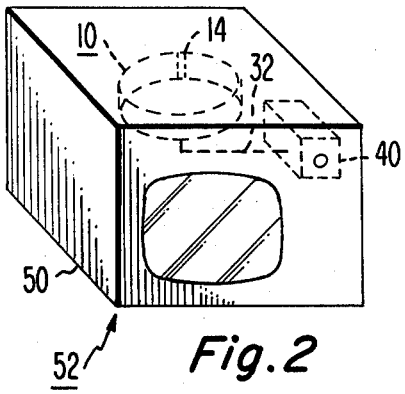
FIG. 2 shows a loop antenna mounted in a television receiver.

Antenna 10 of FIG. 1 is oriented in a horizontal plane and mounted within cabinet 50 of television receiver 52 as is shown in FIG. 2. One possible location of antenna 10 is shown. It is connected to tuner 40 by coaxial cable 32. It is desirable that loop 12 lie in a single plane to the maximum extent practicable so that a more uniform, omnidirectional reception pattern shall obtain. The present inventors have experienced substantially improved ease of tuning and reduced sensitivity to transmission line impedance mismatch and length with the present invention than could be obtained merely by properly matching the characteristic impedance of the transmission line. Although the present inventors contemplate that antenna arrangements of the present invention may also receive signals in the UHF television bands, a separate UHF antenna is presently preferred.

Figure 3:
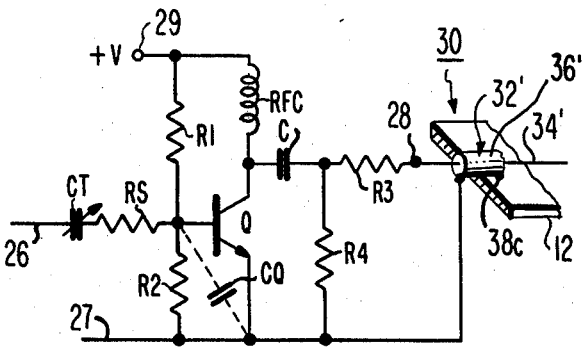
FIGS. 3 and 4 are electrical circuits useful in the present invention.
Figure 4:
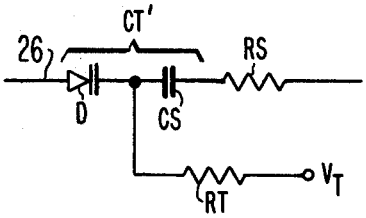

Circuitry for tuning antenna 10 and for coupling signals therefrom to transmission line 30 is shown in FIGS. 3 and 4. Tuning circuitry including capacitor CT and resistor RS is connected to signal terminal 16 via conductor 26. Conductor 27 serves as a common terminal and connects to signal terminal 18. Tuning is accomplished by varying the capacitance of CT so that it resonates with the inductive reactance of antenna 10 at a desired frequency. Resistor RS controls the sharpness of the resonance and therefore the bandwidth over which the antenna is tuned. Because a loop antenna tends to have a high quality factor Q and a narrow bandwidth, such control is needed to accomodate the 6 MHz bandwidth of television channel. Where sufficient resistive impedance is present either from the antenna or from subsequent circuitry, e.g., the input resistance of the amplifier including transistor Q, a physical resistor RS may not be required. Tuning is accomplished over at least a portion of the television frequency bands.

CT may be a mechanically variable capacitor or may be an electrically variable capacitor. In FIG. 4, capacitor CT' includes varactor diode D exhibiting a variable capacitance responsive to the magnitude of the reverse bias potential thereacross. Tuning voltage $V_T$ is applied, for example, to the cathode of varactor diode D through resistor RT. RT may be satisfactorily replaced by any element, such as an RF choke, which exhibits an impedance at the VHF television frequencies which is high relative to the impedance of the path through CS and RS. An improved tuning circuit is described in U.S. patent application Ser. No. 210,247 entitled AUTOMATIC TUNING CIRCUIT ARRANGEMENT WITH SWITCHED IMPEDANCES filed by R. Torres and J. G. N. Henderson on even date herewith and assigned to the same assignee as is the present application and which is incorporated herein by reference. That tuning circuit includes switched tuning elements believed necessary for tuning over the entire lower and upper VHF television frequencies.

In FIG. 3, signals from the tuning circuitry are coupled to output terminal 28 by a common-emitter amplifier. Transistor Q receives those signals at its base and supplies output signals from its collector. In practical transistors, an input capacitance, shown in phantom as capacitor CQ, contributes to the tuning function. Although antenna 10 could be tuned by either a series connected tuning circuit or a parallely connected tuning circuit, the circuit of FIG. 3 operates in both modes, i.e., series tuning is performed by CT and parallel tuning by CQ.

Transistor Q is conditioned for conduction in its active region responsive to operating potential +V at supply terminal 29 applied to its base through the R1, R2 resistive voltage divider. Signals at the collector of transistor Q are directed towards output terminal 28 through capacitor C and resistor R3 which desirably exhibit a low impedance as compared to that of inductor RFC at VHF television frequencies. Resistor network R3, R4 controls the impedance exhibited at output terminal 28 so that it is nominally close in value to the characteristic impedance of transmission line 30.

In the circuit of FIG. 3, isolation is provided in three substantial ways. Firstly, transistor Q amplifies signals in the direction from its base to its collector. That amplification is substantially unaffected by the load impedance connected to its collector. Secondly, transistor Q attenuates signals in the direction from its collector to its base so that signals arising, for example, due to reflected signals on transmission line 30 do not affect the circuits connected to the base of Q. Thirdly, the R3, R4 network increases isolation by further attenuating reflected signals from transmission line 30 as they pass from output terminal 28 to the collector of Q.

In one circuit constructed according to FIG. 3, the following approximate element values were employed:

| | |
|---|---|
| RT | 10 ohm |
| R1 | 20 kilohm |
| R2 | 3 kilohm |
| R3 | 33 ohm |
| R4 | 100 ohm |
| CT | 9 picoFarads @ VHF channel 4 |
| C | 91 picoFarads |
| RFC | 10 microHenry |
| Q | 2 SC 2369 |
| +V | +10 volts |

That embodiment exhibited a net gain of 20 dB, including 10 dB of loss in the R3, R4 network, and a 6 MHz bandwidth at VHF channel 4.

The amplifier including transistor Q and resistor network R3, R4 serve the necessary function of isolating the tuning circuitry from transmission line 30. Thus, the tuning of antenna 10 is unaffected by the impedance connected at output terminal 28, in particular, that of transmission line 30 and tuner 40.

In the embodiment of FIG. 3, transmission line 30 is shown specifically as coaxial cable 32' having its center conductor 34' connected to output terminal 28 and its outer conductor 36' connected to common terminal 27. Coaxial cable 32 is disposed along metal band 12 with outer conductor 36' electrically connected to metal band 12 at a plurality of points, one of which is shown by way of example as 38C.

Figure 5:
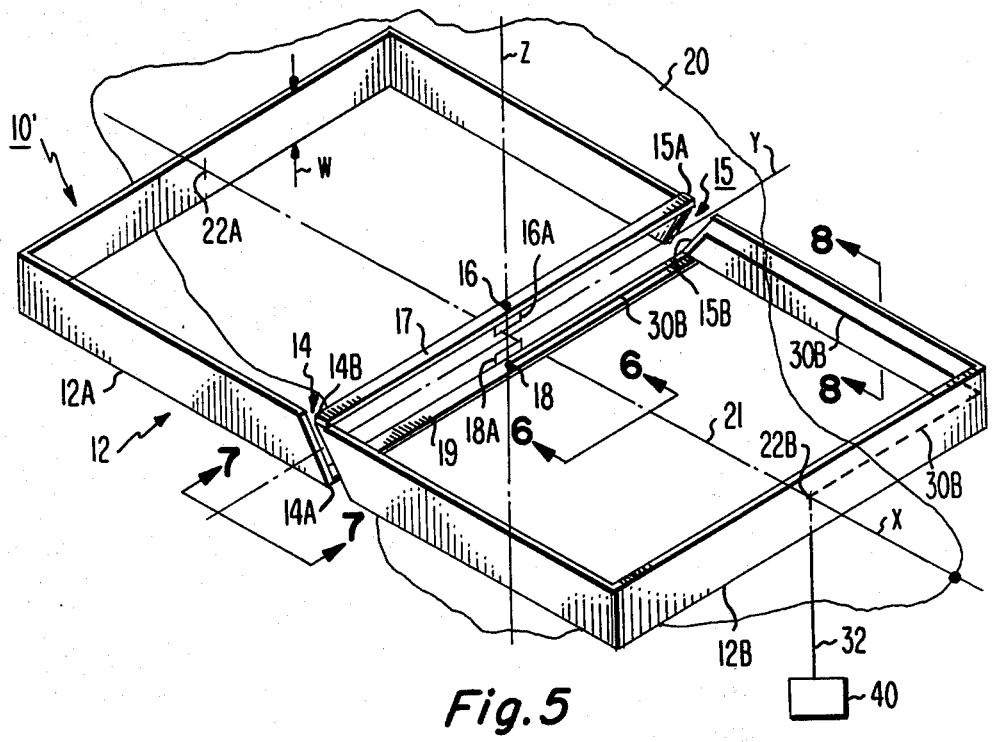

FIG. 5 shows an alternative embodiment including the present invention differing from that of FIG. 1 in that it is of rectangular shape and in that it includes two gaps 14 and 15 symmetrically disposed thereon. As the number of gaps is increased, the degree to which the reception pattern of the antenna remains omnidirectional at higher frequencies improves. I.e., at higher frequencies where the dimensions of the antenna are less small as compared to the wavelength of the received signal. An arrangement for improving omnidirectionality at high VHF frequencies is described in U.S. patent application Ser. No. 210,249 entitled IMPROVED LOOP ANTENNA ARRANGEMENT FOR INCLUSION IN A TELEVISION RECEIVER filed by R. Torres and O. M. Woodward on even date herewith and assigned to the same assignee as is the present application and which is incorporated herein by reference. To simplify the description, antenna 10' is oriented with respect to a set of orthogonal axes X, Y and Z.

Rectangular loop antenna 10' lies in the X,Y plane symmetrically disposed about the X and Y axes. Gaps 14 and 15 respectively define feed terminals 14A, 14B and 15A and 15B which divide loop 12 into portions 12A and 12B of a continuous single loop. Gaps 14 and 15 are desirably located so as to divide loop 12 into substantially equal halves. Portions 12A and 12B are desirably formed from metal bands, the width W of which is oriented perpendicularly with respect to the X,Y plane of the loop 10'. Width W is oriented similarly to that described above in relation to FIG. 1. Neutral points 22A and 22B exist at the intersection of the X axis with bands 12A and 12B respectively. Neutral plane 20 in which neutral points 22A and 22B lie, is the X,Z plane which intersects the loop X,Y plane at intersection line 21, i.e. the X axis.

Signal terminal 16 is connected to feed terminals 14B and 15A by conductor 17; signal terminal 18 is connected to feed terminals 14A and 15B by conductor 19. By those connections, a single continuous loop is maintained. Conductors 17 and 19 form a balanced transmission line between gaps 14 and 15. Signal terminals 16 and 18 are as close as possible to gaps 14 and 15, being located halfway therebetween along balanced transmission line 17, 19. Tabs 16A and 18A are convenient means by which signal terminals 16 and 18 are connected to tuning and coupling circuitry, such as that described above, by a very short length of conductor.

Figure 6:
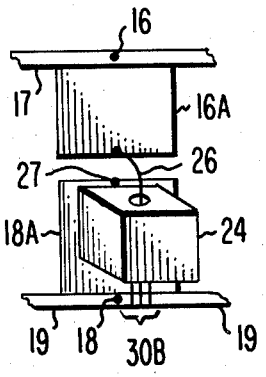
FIGS. 6, 7 and 8 are details of the embodiment of FIG. 5.

The view of FIG. 6 shows details of the arrangements at tabs 16A and 16B. The input terminal of the tuning circuitry connects to signal terminal 16 by conductor 26 and tab 16A while the common terminal thereof connects to terminal 18 by connection 27 and tab 18A. As was the case for antenna 10 of FIG. 1, the tuning and isolation circuitry is desirably enclosed in an electrically conductive container 24 shown mounted, by way of example, proximate to signal terminal 18 at tab 18A. Transmission line 30B is arranged along the periphery of the loop between output terminal 28 and a neutral point. An example of one such arrangement shown in FIG. 5 is along conductor 19 to band 12B at the vicinity of feed terminal 15B and then along metal band 12B to neutral point 22B. Transmission line 30B departs from the loop at neutral point 22B and continues desirably in neutral plane 20 via coaxial cable 32, for example, to tuner 40. Neutral point 22B is conveniently grounded at tuner 40. Thus, the fields associated with line 30B tend not to interfere with the fields of antenna 10'.

Figure 7:
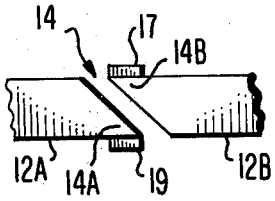

FIG. 7 shows a detail of a desirable arrangement for gap 14, to which gap 15 is similar. Because gaps 14 and 15 are formed with opposing angles, a single continuous loop is maintained. Gap 14 divides loop 12 into bands 12A and 12B at an acute angle with respect to the direction along the loop and defines feed terminals 14A and 14B, as described above. By employing gaps of the type shown in FIG. 7, the simple balanced transmission line formed by conductors 17 and 19 transposes connections to loop portions 12A and 12B to maintain a single continuous loop. Thus conductors 17 and 19 need not be twisted or crossed in space. The described arrangement is advantageous in that the fields associated with such balanced transmission line tend not to disturb the reception pattern of the antenna. It is also more easily economically manufactured than is a twisted transmission line.

In one construction of antenna 10' of the sort shown in FIG. 5 for VHF television reception, bands 12A and 12B were formed from two-inch wide copper strips having gaps 14 and 15 oppositely disposed at 45° angles. Conductors 17 and 19 are suitably ¾-inch wide copper strips parallely spaced two inches apart to provide a balanced transmission line of approximately 300 ohm characteristic impedance. The rectangular loop was of 12 inch dimension along the Y axis direction and of 26 inch dimension along the X axis direction. That arrangement was tested in a television receiver type FB-528W, sold by RCA Corp., which has a 25-inch kinescope and a CTC-90 series chassis. That rectangular size and shape is particularly suited to the size and shape of a television receiver cabinet. Bands 12A and 12B could be glued or otherwise affixed to the inside of such cabinet in a horizontal plane, in substantially the shape shown. One such arrangement is described in U.S. patent application Ser. No. 210,249 entitled IMPROVED LOOP ANTENNA ARRANGEMENT FOR IN- CLUSION IN A TELEVISION RECEIVER referred to hereinabove. That arrangement includes further gaps in loop 12 and switch means connected across the gaps so the reception pattern of the antenna arrangement may be steered. Such steering is believed desirable to counter the loss in omnidirectionality of the antenna arrangement in the upper VHF television frequency band, particularly at higher channels (e.g. channel 13), where the antenna is less electrically small relative to the wavelength of the received signal. Suitable steering apparatus is described in U.S. patent application Ser. No. 210,248 entitled APPARATUS FOR AUTOMATICALLY STEERING AN ELECTRICALLY STEERABLE TELEVISION ANTENNA filed by J. G. N. Henderson on even date herewith and assigned to the same assignee as is the present invention, and which application is incorporated herein by reference.

Figure 8:
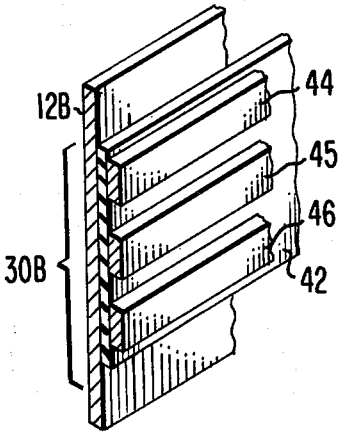

FIG. 8 shows a desirable embodiment of transmission line 30B which includes band 12B as one conductor thereof. A plurality of parallel arranged conductors 44, 45 and 46 are uniformly spaced away from band 12B by strip 42 of electrically insulating material. In practice, band 12B would conduct ground potential to common terminal 27, and conductor 45 would conduct signals from output terminal 28. Conductor 44 could conduct operating potential +V to an amplifier of the sort shown in FIG. 3, and conductor 46 could supply control potential $V_T$ to variable capacitance diode D such as that shown in FIG. 4. It is understood that such transmission line arrangements are suitably employed with other embodiments of the present invention, such as that of FIG. 1.

Modification as to the specific embodiments discussed with reference to FIGS. 1–8 are contemplated to be within the scope of the present invention as defined by the following claims. For example, a loop having more than two gaps may be employed. Such loop might conveniently be circular having three gaps symmetrically disposed 120° apart thereon. Balanced transmission line would connect between each set of feed terminals thus formed and signal terminals located at the center of the loop.

Furthermore, it is satisfactory that alternative forms of tuning and isolating circuitry be employed in place of those shown by way of example in FIGS. 3 and 4 and those in the application Ser. No. 210,247 of Torres and Henderson referred to above. While it is considered desirable that those circuits be enclosed within a container of electrically conductive material, such container is not necessary to the invention. Where such container is employed in an antenna of the form shown in FIG. 5, a further container of electrically conductive material and of similar size and shape to container 24 could be mounted on tab 16A symmetrically disposed with container 24 on tab 18A.

Although single-turn loops are described herein, the present inventors contemplate multiple turn arrangements as well. Multiple-turn arrangements are, however, much more difficult to build.

Furthermore, it is satisfactory that a separate wide conductor be employed in transmission line 30B of FIG. 8 in antenna arrangements according to the present invention, such as the embodiments of FIGS. 1 and 5, for example. Line 30B is equally satisfactory if routed via conductor 19 and band 12A to neutral point 22A, or by any other equivalent route.

What is claimed is:

1. An antenna arrangement for inclusion within a cabinet of a receiver including a tuner and operable over selected frequency bands comprising:

a loop of electrically conductive material, having at least one gap, said gap forming respective first and second feed terminals, said loop having at least one neutral point thereon at which a potential equal to the average of potentials at said first and second feed terminals is developed when electromagnetic radiation impinges upon said loop;

circuit means having input and common terminals for receiving an input signal therebetween, and having an output terminal for supplying an output signal responsive to said input signal, said circuit means being located proximate to said gap and including means for respectively coupling said input and common terminals to the first and second feed terminals of said gap, tuning circuitry connected between said input and common terminals for tuning said loop over at least a portion of said selected frequency bands, and means for coupling signals from said tuning circuitry to said output terminal, said signal coupling means isolating said tuning circuitry for making said tuning circuitry substantially unaffected by an impedance at said output terminal; and a transmission line having a conductor connected to said output terminal for receiving said output signal and for coupling said output signal to said tuner, said transmission line conductor being disposed along the periphery of said loop between said output terminal and said neutral point and departing from said loop proximate to said neutral point.

2. The antenna arrangement of claim 1 wherein a substantial part of said loop lies in a plane and wherein said loop is formed from a band of said electrically conductive material, the width of said band being oriented substantially perpendicular to said plane.

3. The antenna arrangement of claim 2 wherein said loop is mounted in said cabinet so that said plane is substantially horizontal.

4. The antenna arrangement of claim 3 wherein said band of electrically conductive material of said loop between said output terminal and said neutral point serves as a conductor for said transmission line.

5. The antenna arrangement of claim 4 wherein said transmission line includes a plurality of signal conductors between said circuit means and said neutral point, one of said signal conductors being said transmission line conductor, each of said signal conductors being substantially uniformly spaced from said band.

6. The antenna arrangement of claim 5 wherein a strip of electrically insulating material is located between said signal conductor and said band to form said uniform space, said signal conductors being affixed to said strip on a side thereof opposite to that affixed to said band.

7. The antenna arrangement of claim 2 wherein said transmission line includes a conductor electrically connected to said band of electrically conductive material at least at a plurality of points between said output terminal and said neutral point.

8. The antenna arrangement of claim 7 wherein said transmission line includes a coaxial cable having a center conductor serving as said transmission line conductor, and having an outer conductor substantially coaxial with said inner conductor, said outer conductor being electrically connected to said band at said plurality of points.

9. The antenna arrangement of claim 1, 2, 3, 4, 5, 6, 7 or 8 wherein said loop has one gap and wherein said circuit means is affixed to said loop proximate to the second feed terminal of said one gap.

10. The antenna arrangement of claim 9 wherein said circuit means is enclosed within a first electrically conductive container that is electrically connected to said loop near said second feed terminal.

11. The antenna arrangement of claim 10 further including a second electrically conductive container of similar shape and size to that of said first container, disposed on said loop proximate to said first feed terminal and electrically connected to said loop near said first feed terminal, said first and second containers being substantially symmetrically disposed with respect to said gap.

12. The antenna arrangement of claim 1, 2, 3, 4, 5, 6, 7 or 8 wherein said loop has a plurality of gaps and wherein said means for respectively coupling comprises:

first and second signal terminals located intermediate to said gaps within an area defined by said loop;

a plurality of balanced transmission lines of same number as said plurality of gaps, each having a first conductor for coupling the first feed terminal of its associated gap to said first signal terminal, and each having a second conductor for coupling the second feed terminal of its associated gap to said second signal terminal;

means for coupling said first signal terminal to the input terminal of said circuit means; and means for mounting said circuit means to said second signal terminal and for coupling said second signal terminal to the common terminal of said circuit means; and wherein said transmission line is further disposed along the second conductor of one of said balanced transmission lines.

13. The antenna arrangement of claim 12 wherein for each said gap: the gap is at an acute angle with respect to a direction along said loop proximate to itself, and wherein the first and second feed terminals lie on a line substantially perpendicular to said direction.

14. The antenna arrangement of claim 1 wherein said tuning circuit includes a capacitance having one of its plates coupled to said input terminal.

15. The antenna arrangement of claim 14 wherein said capacitance is variable.

16. The antenna arrangement of claim 15 wherein said capacitance includes a varactor diode having anode and cathode electrodes for exhibiting said capacitance therebetween responsive to a control potential, and further includes means for applying said control potential between the anode and cathode of said varactor diode.

17. The antenna arrangement of claim 16 wherein said transmission line includes a plurality of signal conductors between said circuit means and said neutral point, one of said signal conductors being said transmission line conductor, each of said signal conductors being substantially uniformly spaced from said band.

18. Tha antenna arrangement of claim 17 wherein a strip of electrically insulating material is located between said signal conductor and said band to form said uniform space, said signal conductors being affixed to said strip on a side thereof opposite to that affixed to said band.

19. The antenna arrangement of claim 18 wherein said means for applying a control potential includes a first one of said signal conductors.

20. The antenna arrangement of claim 1, 14, 15 or 16 wherein said means for coupling signals comprises:

amplifying means having an input connection for receiving said signals from said tuning circuit, and having an output connection for supplying said output signals responsive to said signals from said tuning circuit; and impedance means for connecting said output connection to said output terminal.

21. The antenna arrangement of claim 20 wherein the input connection of said amplifying means exhibits an input impedance having a reactive component for cooperating with said tuning circuit for tuning said loop.

22. The antenna arrangement of claim 20 wherein said impedance means includes a first resistance connected between said output connection and said output terminal, and a second resistance connected between said output connection and said common terminal.

23. The antenna arrangement of claim 20 wherein said amplifying means includes a supply terminal for receiving operating potential;

a transistor having an input electrode to which said input connection is coupled and having a conduction path between output and common electrodes; and means for coupling the conduction path of said transistor between said supply and common terminals and for coupling one of the output and common electrodes of said transistor to the output connection of said amplifying means.

24. The antenna arrangement of claim 23 wherein said transmission line includes a plurality of signal conductors between said circuit means and said neutral point, one of said signal conductors being said transmission line conductor, each of said signal conductors being substantially uniformly spaced from said band.

25. The antenna arrangement of claim 24 wherein a strip of electrically insulating material is located between said signal conductor and said band to form said uniform space, said signal conductors being affixed to said strip on a side thereof opposite to that affixed to said band.

26. The antenna arrangement of claim 25 wherein a first one of said signal conductors connects to said supply terminal for conducting said operating potential thereto.

27. An antenna arrangement for inclusion within a cabinet of a television receiver including a tuner and operable over television frequency bands comprising:

a single-turn loop formed from a strip of electrically conductive material, having two gaps oppositely disposed thereon, each said gap being at a predetermined acute angle with respect to a direction along said strip, each said gap forming respective first and second feed terminals, wherein a substantial part of said loop lies in a plane and wherein said strip has a width that is oriented substantially perpendicular to said plane, said loop having two neutral points thereon at which a potential equal to the average of potentials at said first and second feed terminals is developed when electromagnetic radiation impinges upon said loop;

first and second signal terminals located intermediate to said gaps within an area defined by said loop;

two balanced transmission lines each having a first conductor for coupling the first feed terminal of its associated gap to said first signal terminal, and each having a second conductor for coupling the second feed terminal of its associated gap to said second signal terminal;

circuit means having input and common terminals for receiving an input signal therebetween, and having an output terminal for supplying an output signal responsive to said input signal, said circuit means being located proximate to said signal terminals and including means for respectively coupling said input and common terminals to said first and second signal terminals, tuning circuitry connected between said input and common terminals for tuning said loop over at least a portion of said television frequency bands, and means for coupling signals from said tuning circuitry to said output terminal, said signal coupling means isolating said tuning circuitry for making said tuning circuitry substantially unaffected by an impedance at said output terminal; and a transmission line having a conductor connected to said output terminal for receiving said output signal and for coupling said output signal to said tuner, said transmission line conductor being disposed along the first conductor of one of said balanced transmission lines and along the periphery of said loop between said output terminal and one of said neutral points and departing from said loop proximate to said one of said neutral points.

28. An antenna arrangement for inclusion within a cabinet of a television receiver including a tuner and operable over television frequency bands comprising:

a loop of electrically conductive material having a gap therein forming respective first and second feed terminals, said loop having a neutral point thereon at which a potential equal to the average of potentials at said first and second feed terminals is developed when electromagnetic radiation impinges upon said loop;

circuit means having input and common terminals for receiving an input signal therebetween, and having an output terminal for supplying an output signal responsive to said input signal, said circuit means being located proximate to said gap and including means for respectively coupling said input and common terminals to the first and second feed terminals of said gap, tuning circuitry connected between said input and common terminals for tuning said loop over at least a portion of said television frequency bands responsive to a control potential, and coupling circuit means for coupling signals from said tuning circuitry to said output terminal, said signal coupling means isolating said tuning circuitry for making said tuning circuitry substantially unaffected by an impedance at said output terminal, said coupling circuit means being conditioned for coupling by an operating potential; and a transmission line for coupling said output signal to said tuner and being disposed along the periphery of said loop between said output terminal and said neutral point and departing from said loop proximate to said neutral point, said transmission line including a plurality of signal conductors substantially uniformly spaced from said loop between said output terminal and said neutral point, a strip of electrically insulating material located between said conductors and said loop to form said uniform spacing, said signal conductors being affixed to said strip on a side thereof opposite to that affixed to said loop, and wherein a first one of said signal conductors couples said output signal to said tuner, a second one of said signal conductors couples said control potential to said tuning circuitry, and a third one of said signal conductors couples said operating potential to said coupling circuit means.

* * * * *